US011276961B2

(12) United States Patent
Di et al.

(10) Patent No.: US 11,276,961 B2
(45) Date of Patent: Mar. 15, 2022

(54) CONNECTOR HOUSING, CONNECTOR HOUSING ASSEMBLY AND CONNECTOR ASSEMBLY

(71) Applicants: Tyco Electronics (Suzhou) Ltd., Suzhou (CN); Tyco Electronics (Shanghai) Co. Ltd., Shanghai (CN)

(72) Inventors: Yongsong Di, Suzhou (CN); Kaixuan Jiang, Shanghai (CN); Haomai Yin, Shanghai (CN)

(73) Assignees: Tyco Electronics (Suzhou) Ltd., Suzhou (CN); Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/887,066

(22) Filed: May 29, 2020

(65) Prior Publication Data

US 2020/0381863 A1 Dec. 3, 2020

(30) Foreign Application Priority Data

May 31, 2019 (CN) ..... 201920814310.5
May 31, 2019 (CN) ..... 201920818253.8

(51) Int. Cl.
*H01R 13/62* (2006.01)
*H01R 13/629* (2006.01)
*H01R 13/631* (2006.01)

(52) U.S. Cl.
CPC ..... *H01R 13/62944* (2013.01); *H01R 13/631* (2013.01)

(58) Field of Classification Search
CPC ..... H01R 13/62944; H01R 13/631
USPC ..... 439/372
See application file for complete search history.

(56) References Cited

U.S. PATENT DOCUMENTS 6,558,176 B1 * 5/2003 Martin ..... H01R 13/62944 439/157
6,705,882 B2 * 3/2004 Casses ..... H01R 13/62933 439/153
6,881,081 B2 * 4/2005 Gundermann ... H01R 13/62944 439/157
6,896,531 B2 * 5/2005 Bakker ..... H01R 13/4538 439/140
6,997,725 B2 * 2/2006 Stella ..... H01R 13/453 439/157
7,396,242 B2 * 7/2008 Dekoski ..... H01R 13/62955 439/157

(Continued)

*Primary Examiner* — Abdullah A Riyami
*Assistant Examiner* — Vladimir Imas
(74) *Attorney, Agent, or Firm* — Potomac Law Group, PLLC

(57) ABSTRACT

The application relates to a connector housing, a connector housing assembly and a connector assembly. The connector housing has a housing body and a shroud. The housing body encloses an accommodating cavity. The shroud is disposed around and connected to the housing body. A gap is formed between the shroud and the housing body to form a slot. The connector housing is further provided with one of a lug or a sliding groove. The lug or the sliding groove is positioned in the slot. According to the connector housing assembly and the connector assembly in the application, the lugs are matched with the sliding grooves to guide the first connector housing and the second connector housing during plug-in connection, so as to avoid failure of installation in place due to relative deflection of them.

17 Claims, 8 Drawing Sheets

(56) References Cited

U.S. PATENT DOCUMENTS 7,568,925 B2 * 8/2009 Ciriello ..... H01R 13/62977 439/157
7,695,296 B1 * 4/2010 Hitchcock ..... H01R 13/62977 439/157
7,726,988 B2 * 6/2010 Martin ..... H01R 13/633 439/157
7,749,004 B2 * 7/2010 Shuey ..... H01R 13/62944 439/157
7,946,874 B2 * 5/2011 Sakamaki ..... H01R 13/5208 439/275
8,105,099 B2 * 1/2012 Suzuki ..... H01R 24/76 439/157
8,182,275 B2 * 5/2012 Suzuki ..... H01R 13/62933 439/157
8,197,270 B2 * 6/2012 Vasbinder ..... H01R 13/62977 439/157
8,226,429 B2 * 7/2012 Umetsu ..... H01R 13/631 439/262
8,356,999 B2 * 1/2013 Imai ..... H01R 13/62944 439/157
8,414,315 B2 * 4/2013 Dekoski ..... H01R 13/62944 439/157
8,439,695 B2 * 5/2013 Komiyama ..... H01R 13/62944 439/157
9,142,916 B2 * 9/2015 Allgood ..... H01R 13/516
9,425,554 B2 * 8/2016 Iwatani ..... H01R 13/635
9,748,693 B1 * 8/2017 Exenberger ..... H01R 13/465
9,899,770 B2 * 2/2018 Yoshida ..... H01R 13/62977
10,290,973 B1 * 5/2019 Gisoldi ..... H01R 13/62944
10,374,356 B2 * 8/2019 Amerio ..... H01R 13/62944
10,411,405 B2 * 9/2019 Obata ..... H01R 13/5025
10,490,938 B2 * 11/2019 Probert ..... H01R 13/62938
10,819,067 B2 * 10/2020 Kanda ..... H01R 13/631
10,873,156 B2 * 12/2020 Shibata ..... G02B 6/44
2006/0040536 A1 * 2/2006 Putnam ..... H01R 13/641 439/157
2009/0042434 A1 * 2/2009 Chazottes ..... H01R 13/4223 439/372
2010/0178791 A1 * 7/2010 Komiyama ..... H01R 13/4361 439/347
2010/0323537 A1 * 12/2010 Vasbinder ..... H01R 13/62977 439/65

* cited by examiner

CONNECTOR HOUSING, CONNECTOR HOUSING ASSEMBLY AND CONNECTOR ASSEMBLY

TECHNICAL FIELD

The present application relates to a connector housing, a connector housing assembly and a connector assembly.

BACKGROUND OF INVENTION

A connector assembly comprises a first housing and a second housing which are disposed to be mutually pluggable. To conveniently plug/unplug, the mating structures that need to be plugged/unplugged are loosely connected. However, such a loose fit may create some problems during plug-in connection: if the first housing and the second housing are mutually inclined in the plugging process, the first housing and the second housing cannot be mounted in place, so that the connection terminal cannot be plugged correctly, and the electrical connection performance cannot meet the requirements.

A connector assembly comprises a first connector housing and a second connector housing which are disposed to be mutually pluggable. A handle is disposed on one of the first connector housing and the second connector housing, the handle is provided with an arc-shaped gear section, and the handle is rotatably disposed; the other is provided with a linear tooth groove section. The gear section and the tooth groove section are engaged with each other and rotated by virtue of the handle, and the gear section drives the linear tooth groove section to move linearly, so that plugging and unplugging of the first connector housing and the second connector housing can be realized. When the connector assembly of this structure is used, it is difficult to avoid misoperation. Due to a short moving distance, the mutual engagement of the gear section and the tooth groove section needs to ensure that the mounting positions of them are accurate, and if improperly mounted, the handle when rotating cannot drive the linear tooth groove to travel a sufficient distance, so that the first connector housing and the second connector housing cannot be plugged in place.

SUMMARY OF THE INVENTION

One of the objectives of the present application is to provide a connector housing, a connector housing assembly, and a connector assembly which can avoid deflection in an assembling process, in order to overcome the disadvantages of the prior art.

According to an aspect of the application, there is provided a connector housing comprising a housing body and a shroud, wherein the housing body encloses an accommodating cavity, and the shroud is disposed around and connected to the housing body, and a gap is formed between the shroud and the housing body to form a slot. The connector housing is further provided with one of a lug or a sliding groove, and the lug or the sliding groove is positioned in the slot.

According to an embodiment of the present application, the lug or sliding groove is disposed on an inner surface of the shroud.

According to an embodiment of the present application, two or more of the lugs and/or the sliding grooves are provided and spaced apart.

According to an aspect of the application, there is provided a connector housing assembly comprising a first connector housing, wherein the first connector housing includes a first housing body, and an outer surface of the housing body is provided with a lug or a sliding groove.

According to an embodiment of the present application, two or more of the lugs and/or the sliding grooves are provided and spaced apart.

According to an embodiment of the present application, the connector housing assembly further includes a second connector housing, wherein the first connector housing is in pluggable plug-in connection with the second connector housing; one of the first connector housing and the second connector housing is provided with a lug, and the other of the first connector housing and the second connector housing is provided with a sliding groove; and the lug is configured to be slidable along the sliding groove when the first connector housing and the second connector housing are plugged or unplugged.

According to an embodiment of the present application, the first connector housing includes a first housing body and a shroud, the first housing body enclosing a first accommodating cavity, the shroud being disposed around and connected to the housing body, a gap being disposed between the shroud and the first housing body to form a slot.

According to an embodiment of the present application, the lug or sliding groove is disposed on an inner surface of the shroud.

According to an embodiment of the present application, the second connector housing comprises a second housing body, the second housing body enclosing a second accommodating cavity, the lug or the sliding groove being disposed on an outer surface of the second housing body.

According to an embodiment of the present application, two or more of the lugs are provided and spaced apart, and the number of the sliding grooves is the same as that of the lugs, and the sliding grooves are positioned to adapt to the positions of the lugs.

According to an embodiment of the present application, the first connector housing is provided with a slot and the second connector housing includes a second housing body enclosing a second accommodating cavity, the second housing body being disposed to be inserted into the slot, one of the lug or the sliding groove being disposed in the slot, and the other one of the lug or the sliding groove being disposed on the second housing body.

According to an embodiment of the present application, the first connector housing includes a first housing body and a shroud, the first housing body enclosing a first accommodating cavity, the shroud being disposed around and connected to the first housing body, a gap being disposed between the shroud and the first housing body to form the slot.

According to an embodiment of the present application, the sliding groove is arranged on the shroud and positioned in the slot; the lug is disposed on the second housing body and protrudes from the second housing body.

According to an embodiment of the present application, the sliding groove is disposed on two opposite sides of the first housing body.

According to an embodiment of the present application, a plurality of terminal protection plates are arranged in the second accommodating cavity, and each of the terminal protection plates encloses a tube cavity.

According to an embodiment of the present application, the connector housing assembly further includes a connector handle, the connector handle being rotatably connected to the first connector housing. The connector handle comprises a connecting portion and a supporting portion, one end of the supporting portion being connected with the connecting portion, the other end of the supporting portion being provided with at least one curved segment, the curved segment being provided with a circumferential side wall, the curved segment being provided with a plurality of first tooth grooves, a first tooth being formed between adjacent two of the first tooth grooves, the plurality of first tooth grooves and a plurality of first teeth all being disposed to be circumferentially spaced apart, the supporting portion being provided with a first lug, the first lug being disposed to radially protrude from the circumferential side wall.

According to an embodiment of the present application, the first lug is disposed behind all of the first tooth grooves in a rotation direction of the supporting portion.

According to an embodiment of the present application, in a rotation direction of the supporting portion, the first lug is disposed behind all of the first teeth.

According to an embodiment of the present application, a thickness of the first lug in a thickness direction of the curved segment is smaller than a thickness of the curved segment.

According to an embodiment of the present application, the first tooth groove extends a selected length along a thickness direction of the curved segment, the length of the first tooth groove being less than the thickness of the curved segment.

According to an embodiment of the present application, the connector handle is U-shaped, the number of the supporting portions is two, and the two supporting portions are respectively arranged at either end of the connecting portion.

According to an embodiment of the present application, the connecting portion is provided to be integrated with the supporting portion.

According to an embodiment of the present application, the supporting portion is further provided with a second lug located at the other side of the plurality of teeth in a circumferential direction; and the plurality of first teeth and first tooth grooves are located between the first lug and the second lug.

According to an embodiment of the present application, the supporting portion is provided with a through-hole extending axially through the supporting portion; an outer wall of the first connector housing is provided with a supporting shaft; the supporting shaft runs through the through-hole, and the supporting portion is sleeved onto the supporting shaft and disposed to be rotatable around the supporting shaft.

According to an embodiment of the present application, the first connector housing is provided with an elastic hook; the supporting portion is further provided with a second lug, the second lug being positioned on the other side of the plurality of tooth grooves along a circumferential direction; the plurality of tooth grooves is positioned between the first lug and the second lug; the elastic hook is matched with the second lug to limit a rotation of the handle; when the elastic hook clamps the first lug, the handle is limited to rotate by the elastic hook, and the handle is able to rotate with respect to the first connector housing upon the elastic hook being forced to move to release the first lug from limitation.

According to an embodiment of the present application, the connector housing assembly further includes a first connection terminal which is mounted within the first connector housing.

According to an embodiment of the present application, the connector housing assembly further includes a second connector housing, the connector handle being rotatably connected to the first connector housing; the first connector housing being in pluggable plug-in connection with the second connector housing; the second connector housing further comprising a linear rack section, the linear rack section comprising a plurality of second teeth, a second tooth groove being formed between the adjacent second teeth; the plurality of first teeth being respectively engaged with the plurality of second tooth grooves, and the supporting portion being disposed to rotate to drive the second connector housing and the first connector housing to move relatively when the plurality of second teeth are respectively engaged with the plurality of first tooth grooves.

According to an embodiment of the present application, a width of the first lug extending circumferentially is larger than a width of the second tooth groove.

According to an embodiment of the present application, the first lug interferes with the second tooth to prevent the first connector housing from being in plug-in connection with the second connector housing when the plurality of first teeth are improperly engaged with the plurality of second tooth grooves.

According to an embodiment of the present application, the connector housing assembly further includes a first connection terminal and a second connection terminal, wherein the first connection terminal is in pluggable plug-in connection with the second connection terminal; when the first connector housing is in plug-in connection with the second connector housing, the first connection terminal is in plug-in connection with the second connection terminal.

According to an embodiment of the application, the connector assembly is a high voltage connector assembly.

According to the connector housing, the connector housing assembly and the connector assembly in the application, the lugs are matched with the sliding grooves to guide the first connector housing and the second connector housing during plug-in connection, so as to avoid failure of installation in place due to relative deflection of the first connector housing and the second connector housing. The provision of the lugs and the sliding grooves as guiding structures can ensure that the first connector housing and the second connector housing are always aligned during plug-in connection with each other, and can be installed in place, so that the first connection terminal and the second connection terminal and other internal electric connection structures can be ensured to be mounted in place, and be convenient to use, and the electric connection performance can be greatly ensured.

According to the connector handle, the connector housing assembly and the connector assembly in the application, the supporting portion is provided with a first lug, the first lug is disposed to protrude from the circumferential side wall, and the first lug cannot be embedded into the second tooth groove. The correct mounting position is that the first tooth is embedded in the second tooth groove, the second tooth is embedded in the first tooth groove, and the first lug is not aligned with the linear rack section. When mismatched, the first lug is positioned to be aligned with the linear rack section. When mismatched, the first lug cannot be embedded into the second tooth groove, so that the rotation force required for the handle to rotate is much larger than the rotation force required when correctly mounted, and an operator can be reminded of being mismatched at the moment. If a mismatch occurs, an operator can easily find a mismatched condition because a larger rotational force needs to be used. According to the application, an operator can be helped to judge whether the first connector housing and the second connector housing are normally assembled or not, and the prevention of the supporting portion from being mis-matched with the linear rack section can avoid the first connector housing and the second connector housing from failure of installation in place, from affecting the electric connection performance, so as to ensure the use convenience and safety of the connector assembly.

DETAILED DESCRIPTION OF EMBODIMENTS

Example 1

Figure 1:
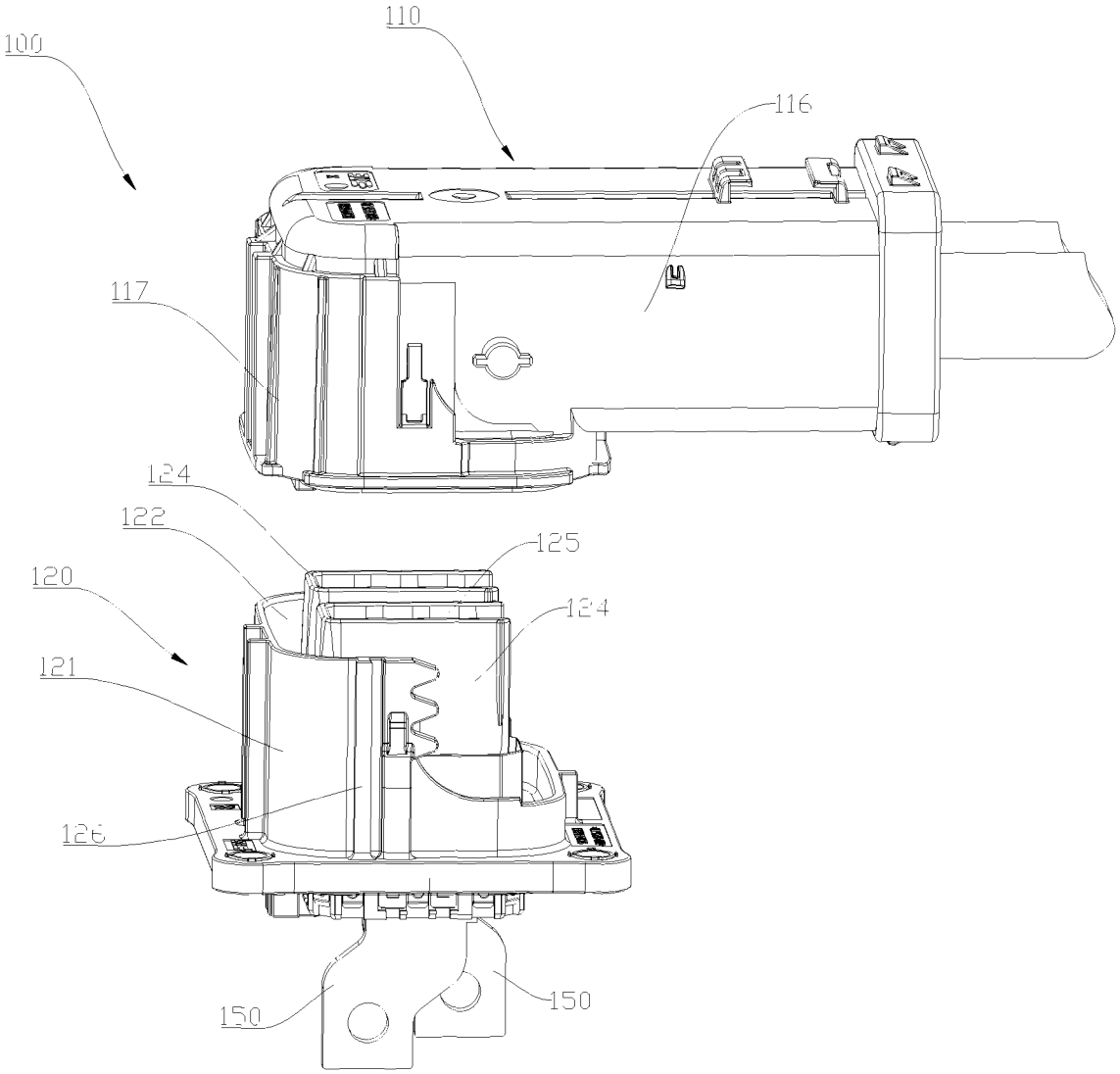
FIG. 1 is a structural schematic view of a connector assembly in Example 1 of the present application.

As shown in FIG. 1, a connector assembly 100 includes a first connector housing 110, a second connector housing 120, a first connection terminal 140, and a second connection terminal 150. The first connection terminal 140 is mounted on the first connector housing 110. The second connection terminal 150 is mounted on the second connector housing 120. The first connector housing 110 is disposed to be pluggable with the second connector housing 120. The first connection terminal is disposed to be pluggable with the second connection terminal 150. When the first housing 110 is in plug-in connection with the second housing 120, the first connection terminal 140 is in plug-in connection with the second connection terminal 150.

Figure 2:
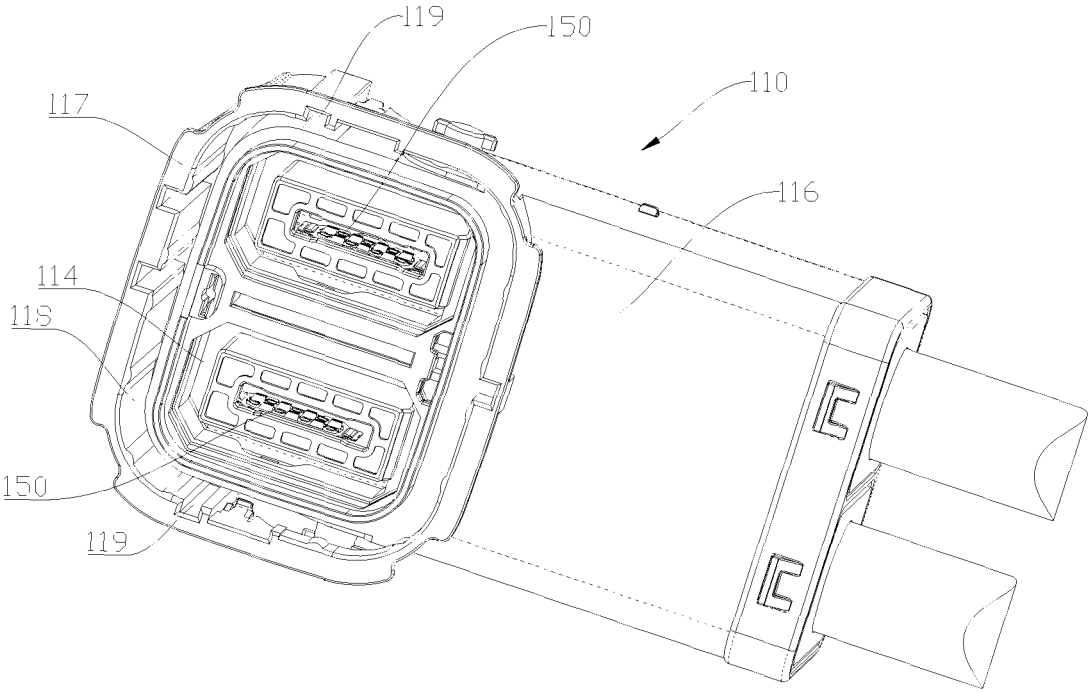
FIG. 2 is a structural schematic view of a first connector housing in Example 1 of the present application.

As shown in FIGS. 1 and 2, the first connector housing 110 includes a first housing body 116 and a shroud 117. The first housing body 116 serves to secure the first connection terminal and the shroud 117. The first housing body 116 may be suitably constructed and shaped according to practical use requirements. The first housing body 116 may be either a 180-degree connector housing or a 90-degree connector housing. In the illustrated example, the first housing body 116 is a 90-degree connector housing; i.e., it has two openings configured to be oriented in 90 degree. In the example shown, one opening is disposed to face down and the other opening to face right. The first housing body 116 encloses a first accommodating cavity 114. The first accommodating cavity 114 is adapted to receive a first connection terminal 140.

The shroud 117 is disposed around the first housing body 116, and both are connected. A gap is formed between the shroud 117 and the first housing body 116 to form a slot 118. The slot 118 is adapted to receive a second shroud to be described later so as to extend a length corresponding to the second housing body 121. The first housing body 116 is provided to be integrated with a shroud 117. The shroud 117 is provided with a sliding groove 119. The sliding groove 119 is located within the slot 118. The sliding groove 119 extends a selected height in a height direction of the first housing body 116.

Figure 3:
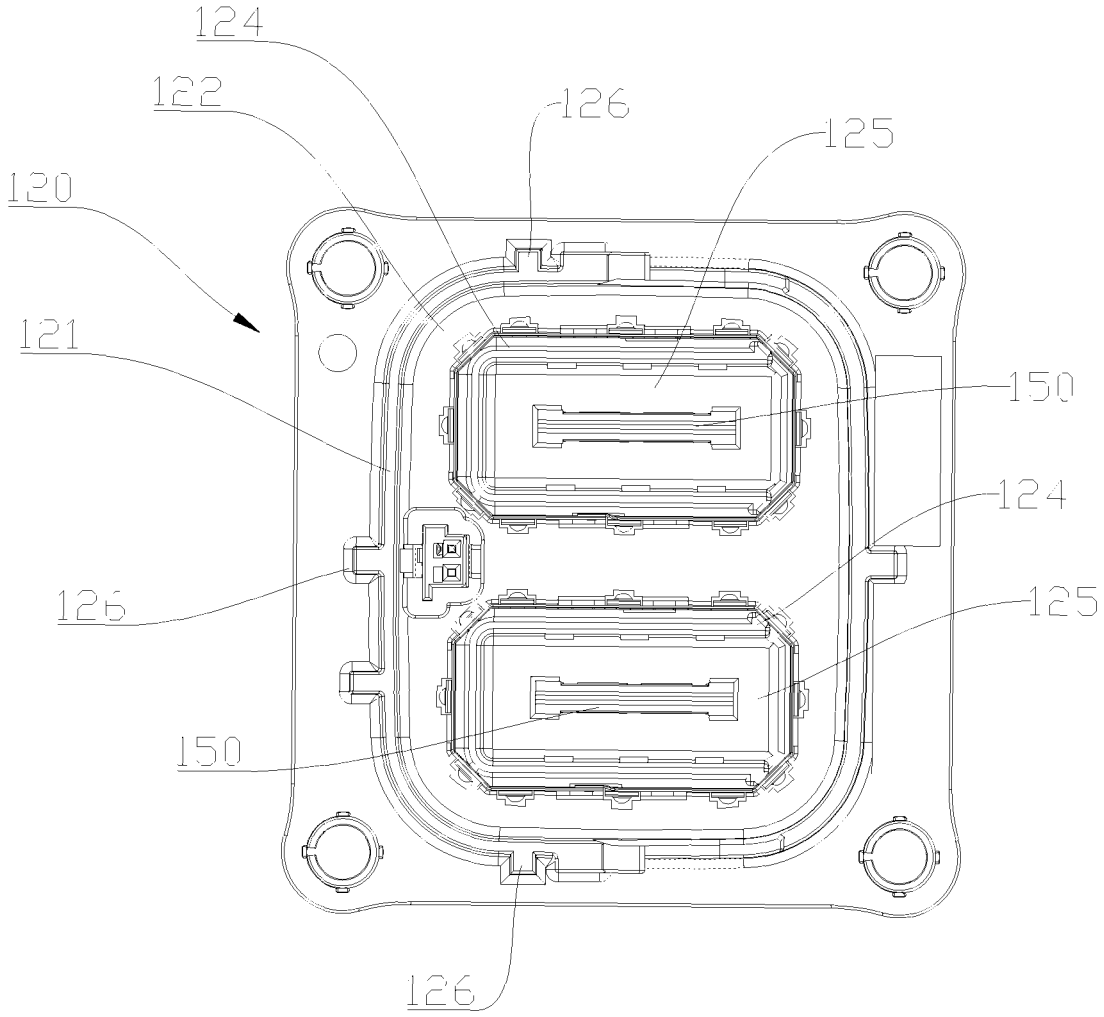
FIG. 3 is a top view of a second connector housing in Example 1 of the present application.

As shown in FIG. 3, the second connector housing 120 includes a second housing body 121 that encloses a second accommodating cavity 122. The second connector housing 120 functions to mount the second connection terminal 150 and to be mated with the first connector housing 110 such that the first connection terminal is pluggably connected with the second connection terminal 150. Therefore, the structure of the second connector 120 can be determined according to actual needs. In the example shown, the second housing body 121 encloses an accommodating cavity 122. The second housing body 121 is provided with a plurality of terminal protection plates 124, each of which encloses a tube cavity 125. The second connection terminal 150 is disposed within the tube cavity 125. An outer surface of the second housing body 121 is provided with a lug 126. The position and number of the lug 126 correspond to the position and number of the above-mentioned sliding groove 119. The lug 126 extends a selected height in a height direction of the second housing body 121.

As shown in FIGS. 1 to 3, when assembled, the first connector housing 110 is in plug-in connection with the second connector housing 120, and the second housing body 121 is inserted into the slot 118. During plug-in connection, the lug 126 is inserted into the sliding groove 119 and is slidable along the sliding groove 119. The lugs are matched with the sliding grooves to guide the first connector housing and the second connector housing during plug-in connection, so as to avoid failure of installation in place due to relative deflection of the first connector housing and the second connector housing.

According to the connector housing assembly and the connector assembly in the Example 1 of the application, the lugs are matched with the sliding grooves to guide the first connector housing and the second connector housing during plug-in connection, so as to avoid failure of installation in place due to relative deflection of the first connector housing and the second connector housing. The provision of the lugs and the sliding grooves as guiding structures can ensure that the first connector housing and the second connector housing are always aligned during plug-in connection with each other, and can be installed in place, so that the first connection terminal and the second connection terminal and other internal electric connection structures can be ensured to be mounted in place, and be convenient to use, and the electric connection performance can be greatly ensured.

Example 2

Figure 4:
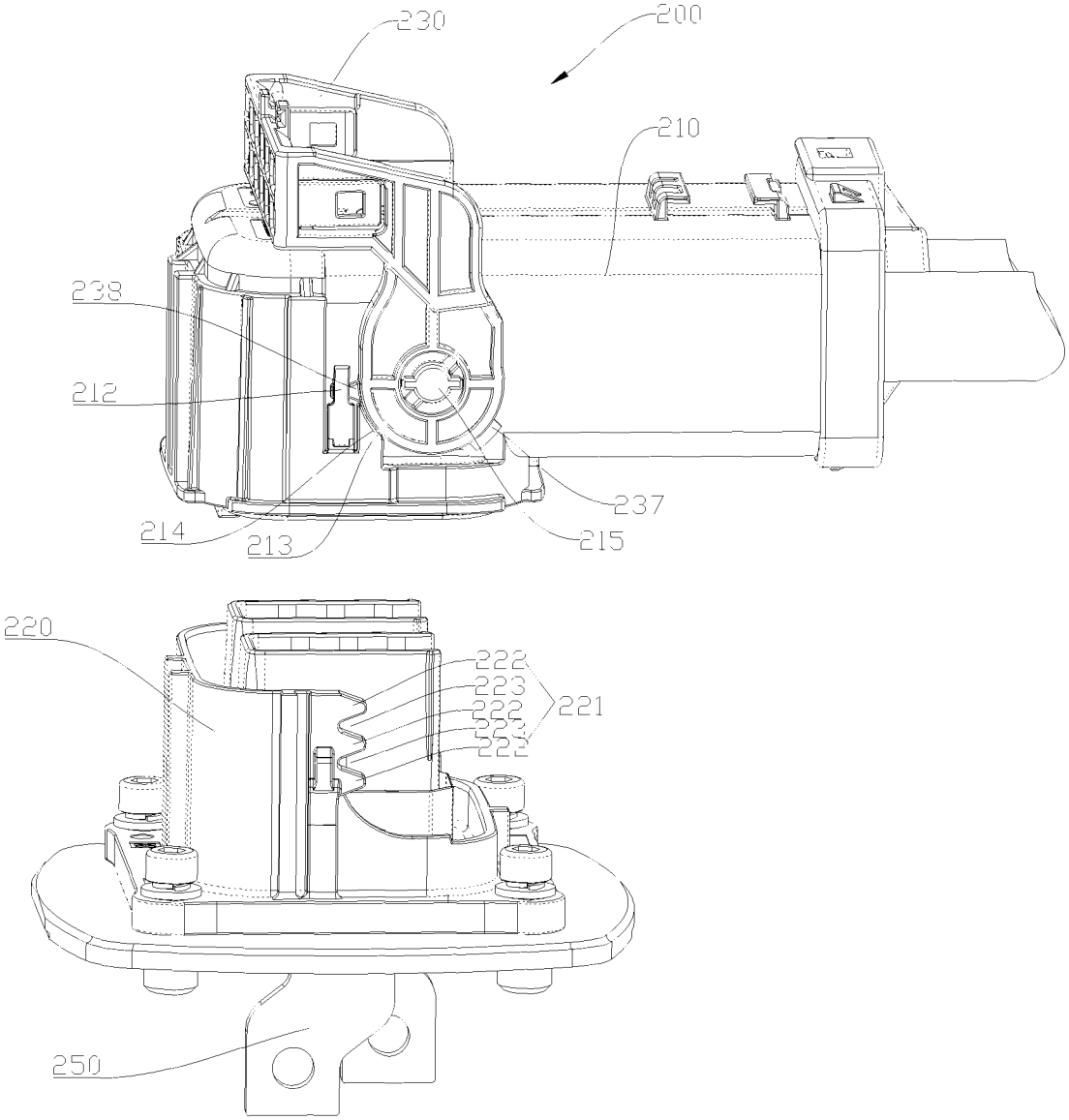
FIG. 4 is a structural schematic view of a connector assembly in Example 2 of the present application.

As shown in FIG. 4, the connector assembly 200 includes a first connector housing 210, a second connector housing 220, a first connection terminal (not shown) and a second connection terminal 250. The first connection terminal is mounted onto the first connector housing 210. The second connection terminal 250 is mounted onto the second connector housing 220. The first connector housing 210 and the second connector housing 220 are pluggably disposed. The first connection terminal and the second connection terminal 250 are pluggably disposed. When the first connector housing 210 is in plug-in connection with the second connector housing 220, the first connection terminal is in plug-in connection with the second connection terminal 250. The structures of the first connector housing 210, the second connector housing 220, the first connection terminal and the second connection terminal 250 can be determined according to actual use requirements, and various structures in prior art can be used. In the example shown, a side wall of the first connector housing 210 is provided with an elastic hook 212. The elastic hook 212 is resiliently disposed such that upon being forced one end of the elastic hook 212 can be pulled away from the first connector housing 210. One side of the elastic hook 212 is provided with a guide plate 213. An upper end 214 of the guide plate 213 has an arc shape. An outer wall of the first connector housing 210 is further provided with a supporting shaft 215. The supporting shaft 215 is provided to protrude from the first connector housing 210. The guide plate 213 is located between the elastic hook 212 and the supporting shaft 215. In the example shown, the first connector housing 210 is provided at either side with an elastic hook 212, a guide plate 213, and a supporting shaft 215, respectively.

The second connector housing 220 is provided with a linear rack section 221. The linear rack section 221 includes a plurality of second teeth 222 with a second tooth groove 223 between adjacent second teeth 222. The number of second teeth 222 may be determined according to actual needs. In the illustrated example, the number of second teeth 222 is three and the number of second tooth grooves 223 is two.

Figure 5:
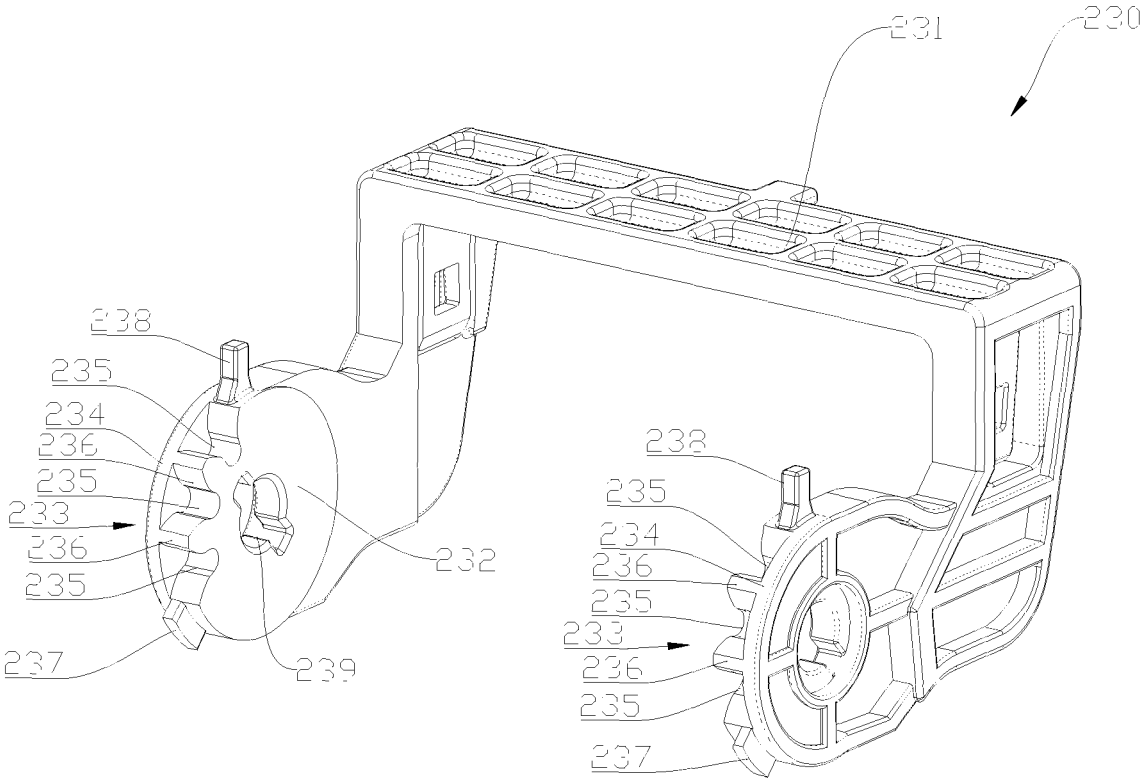
FIG. 5 is a structural schematic view of a connector handle in Example 2 of the present application.
Figure 6:
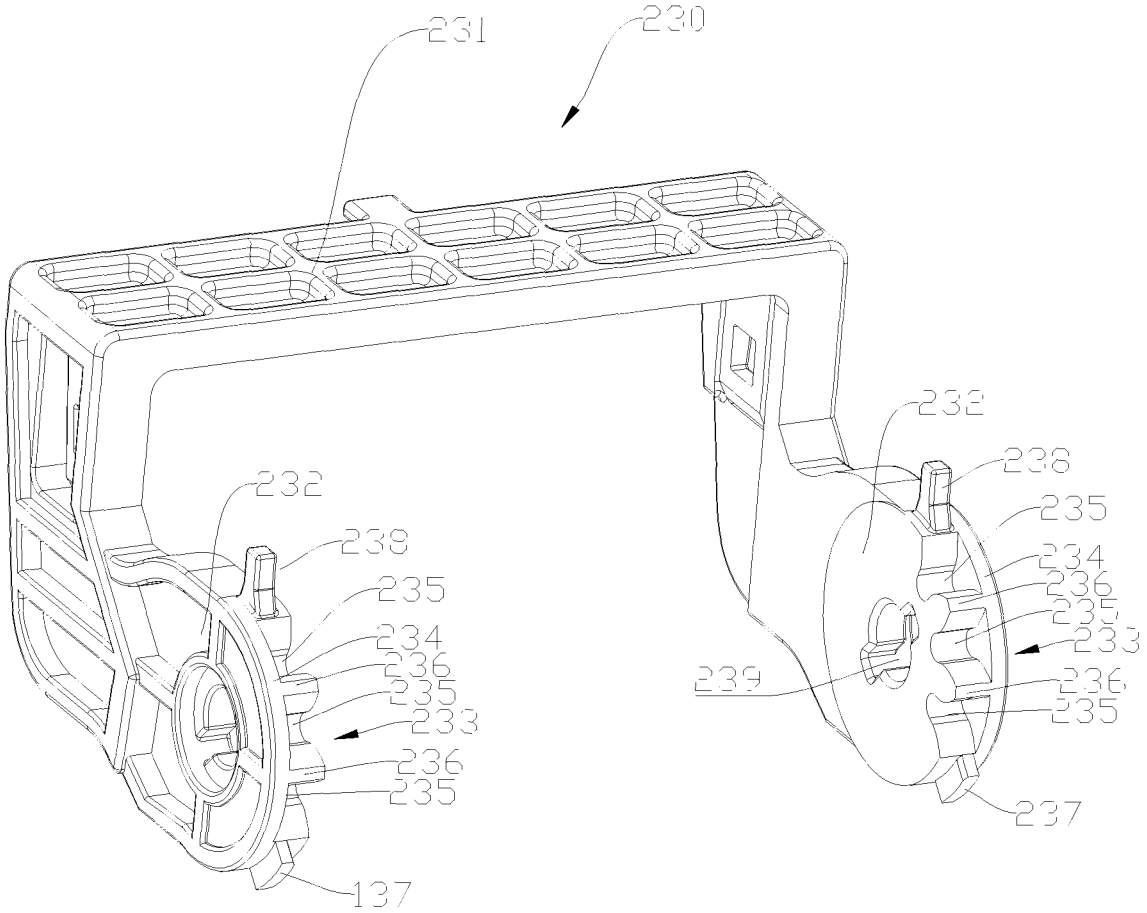
FIG. 6 is a structural schematic view of the connector handle of Example 2 viewing from another angle.

As shown in FIGS. 5 and 6, the connector assembly 200 in the present application further includes a connector handle 230. The connector handle 230 includes a connecting portion 231 and a supporting portion 232. The connecting portion 231 is used for an operator to hold and is convenient to operate. In the illustrated example, the connector handle 230 is generally U-shaped having two ends. The connector handle 230 straddles the first connector housing 210 with the two ends located on either side of the first connector housing 210, respectively.

One end of the supporting portion 232 is connected with the connecting portion 231, and the other end of the supporting portion 232 is provided with at least one curved segment 233. The curved segment 233 is provided with a circumferential side wall 234, the curved segment 233 is provided with a plurality of first tooth grooves 235, and the first tooth grooves 235 extend from the circumferential side wall 234 towards the center of the circle. A first tooth 236 is formed between two adjacent first tooth grooves 235. The plurality of first tooth grooves 235 and a plurality of first teeth 236 are all disposed to be circumferentially spaced. The first tooth groove 235 extends a selected length in a thickness direction of the curved segment 233. The length of the first tooth groove 235 is smaller than the thickness of the curved segment 233; that is, the first tooth groove 235 does not run through the curved segment 233 in the thickness direction of the curved segment 233.

Figure 7:
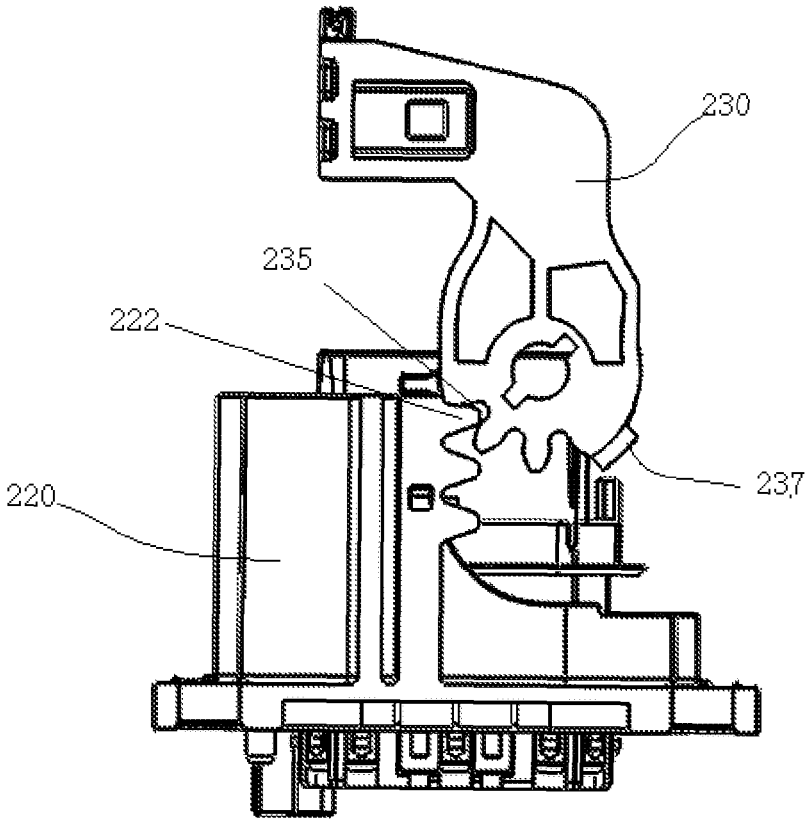
FIG. 7 is a schematic view of the matching relationship between the linear rack section of the second connector housing and the connector handle in Example 2.

A first lug 237 and a second lug 238 are provided on the circumferential side wall 234, and both the first lug 237 and the second lug 238 are disposed to protrude from the circumferential side wall 234 and to be spaced apart. The plurality of first tooth grooves 235 are disposed between the first lug 237 and the second lug 238. According to the technical solution of the present application, in a rotation direction of the supporting portion 232, for example, as shown in FIG. 7, 5 or 6, the supporting portion 232 is rotated clockwise, and the first lug 237 is provided behind all the first tooth grooves 235. The second lug 238 is disposed in front of the first tooth groove 235. The thickness of the first lug 237 is less than the thickness of the curved segment 233.

The supporting portion 232 is provided with a through-hole 239 extending through the supporting portion 232 in an axial direction, that is, in a thickness direction. The through-hole 239 is provided at the center of the curved segment 233. According to a preferred aspect of the present application, the connector handle 230 is integrally formed.

As shown in FIG. 4, when the connector handle 230 is mounted on the first connector housing 210, the supporting shaft 215 penetrates through the through-hole 239, and the supporting portion 232 is sleeved over the supporting shaft 215 and is rotatable about the supporting shaft 215. The second lug 238 is clamped by the elastic hook 212. A section of the circumferential side wall 234 where the first tooth groove 235 is not provided in the thickness direction is opposite to an upper end 214 of the guide plate 213 and has a gap in between. When the elastic hook 212 hooks the second lug 238, the supporting portion 232 cannot rotate. The elastic hook 212 is pulled such that it no longer restrains the second lug 238, at which time the supporting portion 232 is rotatable about the supporting shaft 215. The upper end 214 of the guide plate 213 can prevent the supporting portion 232 from being deflected when the supporting portion 232 is rotated.

Figure 8:
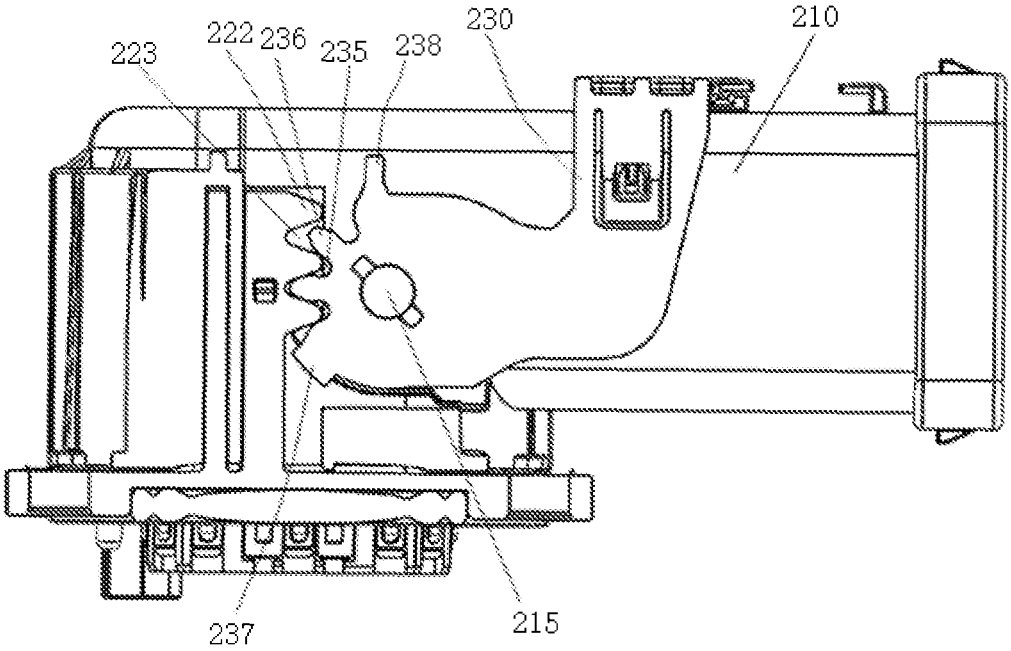
FIG. 8 is a schematic view showing one of the states in which the connector assembly in Example 2 of the present application is properly assembled.

As shown in FIGS. 4 to 7, when the first connector housing 210 and the second connector housing 220 are in plug-in connection with each other, the first tooth groove 235 and the first tooth 236 at the curved segment 233 are respectively engaged with the linear rack section 221, the first tooth 236 is inserted into the second tooth groove 223, and the second tooth 222 is inserted into the first tooth groove 235. When the supporting portion 232 is rotated, with such an engagement relationship, the supporting portion 232 can drive the linear rack section 221 and the second connector housing 220 to move linearly. When the second connector housing 220 is positioned below and the first connector housing 210 is positioned above, a clockwise rotation can pull the second connector housing 220 upward until the first connector housing 210 and the second connector housing 220 are plugged into place and connected with each other and the first connection terminal and the second connection terminal 250 are plugged into place and connected. As shown in FIG. 7, in a correct assembly manner, the uppermost second tooth 222 is embedded in the forward-most first tooth groove 235 in the clockwise direction, so that the supporting portion 232 can be ensured to be rotated by an angle large enough to enable the second connector housing 220 to travel upward as much as possible. The connector handle 230 is rotated clockwise, and when properly assembled, the connector handle 230 may be rotated clockwise by a sufficient angle such that the lowermost second tooth 222 is inserted into the last first tooth groove 235 in the clockwise direction. As shown in FIG. 8, when the connector handle 230 is rotated by 90 degrees in the clockwise direction with respect to the state in FIG. 7, the connecting portion 231 abuts against the first connector housing 210.

Figure 9:
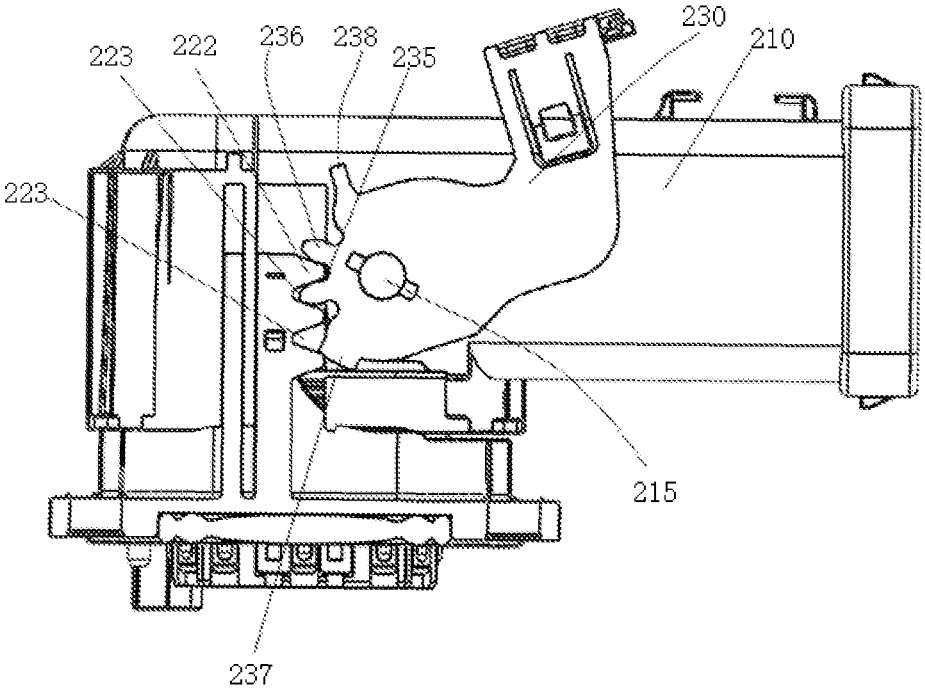
FIG. 9 is a schematic view showing a state in which the connector assembly in Example 2 of the present application is improperly assembled.

As shown in FIG. 9, when mismatched, that is, the uppermost second tooth 222 is inserted into the second, or the third, first tooth groove 235 in the clockwise direction, this condition is referred to as improper engagement. When the connector handle 130 is not rotated 90 degrees in the clockwise direction, the first lug 237 abuts against the linear rack section 221. Since the first lug 237 protrudes from the circumferential side wall 234, and the length of the first lug 237 is greater than the width of the second tooth groove 223, the first lug 237 cannot be inserted into the second tooth groove 223, and thus the connector handle 230 cannot be rotated clockwise continuously, or a larger force is required to rotate the connector handle 230 than that would be during proper engagement. The first lug 237 interferes with the linear rack section 221 such that the connector handle 230 cannot be rotated clockwise into position and also the linear rack section 221 cannot be pulled upward into position, thereby preventing the first connector housing 210 and the second connector housing 220 from being plugged in place. The operator can determine whether the first connector housing 210 and the second connector housing 220 are plugged in place and whether the first connection terminal and the second connection terminal 250 are plugged in place according to whether the force to rotate the connector handle 230 clockwise exceeds a normal range or whether it can be rotated clockwise into place. Whether the electric connection function is normal can be further judged.

According to the connector handle, the connector housing assembly and the connector assembly in Example 2 of the application, the supporting portion is provided with a first lug, the first lug is disposed to protrude from the circumferential side wall, and the first lug cannot be embedded into the second tooth groove. The correct mounting position is that the first tooth is embedded in the second tooth groove, the second tooth is embedded in the first tooth groove, and the first lug is not aligned with the linear rack section. When mismatched, the first lug is positioned to be aligned with the linear rack section. When mismatched, the first lug cannot be embedded into the second tooth groove, so that the rotation force required for the handle to rotate is much larger than the rotation force required when properly mounted, and an operator can be reminded of being mismatched at the moment. If a mismatch occurs, an operator can easily find a mismatched condition because a larger rotational force needs to be used. According to the application, an operator can be helped to judge whether the first connector housing and the second connector housing are properly assembled or not, and the prevention of the supporting portion from being mis-matched with the linear rack section can avoid the first connector housing and the second connector housing from failure of installation in place, from affecting the electric connection performance, so as to ensure the use convenience and safety of the connector assembly.

The connector assembly of the application is particularly suitable for use as a high voltage connector assembly.

The above is merely a preferred embodiment of the present application, and is not intended to limit the scope of the present application, and any modifications, equivalent substitutions or improvements within the spirit of the present application are intended to be covered within the scope of the claims of the present application.

We claim:

1. A connector housing, comprising a housing body and a shroud, wherein the housing body encloses an accommodating cavity, the shroud is disposed around and connected to the housing body, and a gap is formed between the shroud and the housing body to form a slot, the slot configured to receive a second housing body of a second connector housing; and the connector housing is further provided with one of a lug or a sliding groove, with the lug or the sliding groove being positioned in the slot, the one of the lug or the sliding groove configured to receive a mating sliding groove or a mating lug of the second housing body of the second connector housing;

wherein the one of the lug or the sliding groove accepts the mating sliding groove or the mating lug of the second housing body of the second connector housing to provide positive alignment of the connector housing with the second connector housing.

2. The connector housing of claim 1, characterized in that the lug or sliding groove is disposed on an inner surface of the shroud.

3. A connector housing assembly, comprising:

a first connector housing; with a first connection terminal provided therein, the first connector housing having a first housing body and a shroud, wherein the first housing body encloses an accommodating cavity, the shroud is disposed partially around and connected to the first housing body, a gap is formed between the shroud and the housing body to form a slot, the first housing body having a first lug or a first sliding groove;

a second connector housing with a second connection terminal provided therein, the second connector housing having a second housing body, and an outer surface of the second housing body having a second lug or a second sliding groove;

wherein the one of the first lug or the first sliding groove accepts the second sliding groove or the second lug to provide positive alignment of the first connector housing with the second connector housing.

4. The connector housing assembly of claim 3, characterized the first housing body encloses a first accommodating cavity, the shroud is disposed around and connected to the first housing body, and a gap is disposed between the shroud and the first housing body to form a slot.

5. The connector housing assembly of claim 4, characterized in that the first lug or the first sliding groove is disposed on an inner surface of the shroud.

6. The connector housing assembly of claim 3, characterized in that second housing body enclosing a second accommodating cavity; and the second lug or the second sliding groove is disposed on an outer surface of the second housing body.

7. The connector housing assembly of claim 3, characterized in that two or more of the first or second lugs are provided and spaced apart, and the number of the first or second sliding grooves is the same as that of the first or second lugs, and the first or second sliding grooves are positioned to adapt to the positions of the first or second lugs.

8. The connector housing assembly of claim 3, characterized in that the first sliding groove is arranged on the shroud and positioned in the slot; and the second lug is disposed on the second housing body and protrudes from the second housing body.

9. The connector housing assembly of claim 3, characterized in that the first sliding groove is arranged on two opposite sides of the first housing body.

10. The connector housing assembly of claim 3, further comprising a connector handle, wherein the connector handle is rotatably connected to the first connector housing, and the connector handle comprises:

a connecting portion;

a supporting portion, one end of the supporting portion being connected with the connecting portion, the other end of the supporting portion being provided with at least one curved segment, the curved segment being provided with a circumferential side wall, the curved segment being provided with a plurality of first tooth grooves, and a first tooth being formed between adjacent two of the first tooth grooves; the plurality of first tooth grooves and a plurality of the first teeth all being disposed to be circumferentially spaced apart;

the supporting portion being provided with a first rotation lug, and the first rotation lug being configured to radially protrude from the circumferential side wall.

11. The connector housing assembly of claim 10, characterized in that in a rotation direction of the supporting portion the first rotation lug is disposed behind all of the first tooth grooves and/or the first rotation lug is disposed behind all of the first teeth.

12. The connector housing assembly of claim 10, characterized in that the supporting portion is further provided with a second rotation lug, the second rotation lug being circumferentially located at the other side of the plurality of teeth; and the plurality of first teeth and first tooth grooves are located between the first rotation lug and the second rotation lug.

13. The connector housing assembly of claim 10, characterized in that the supporting portion is provided with a through-hole extending axially through the supporting portion; an outer wall of the first connector housing is provided with a supporting shaft; the supporting shaft runs through the through-hole, and the supporting portion is sleeved onto the supporting shaft and disposed to be rotatable around the supporting shaft.

14. The connector housing assembly of claim 10, characterized in that the first connector housing is provided with an elastic hook; the supporting portion is further provided with a second rotation lug, and the second lug is positioned on the other side of the plurality of tooth grooves along a circumferential direction; the plurality of tooth grooves are positioned between the first rotation lug and the second rotation lug; the elastic hook is matched with the second rotation lug to limit a rotation of the handle; when the elastic hook clamps the first rotation lug, the handle is limited to rotate by the elastic hook, and the handle is rotatable with respect to the first connector housing upon the elastic hook being forced to move to release the first rotation lug from limitation.

15. The connector housing assembly of claim 10, wherein the first connector housing is in pluggable plug-in connection with the second connector housing;

the second connector housing further comprises a linear rack section, the linear rack section comprising a plurality of second teeth, a second tooth groove being formed between the adjacent second teeth;

the plurality of first teeth are respectively engaged with the plurality of second tooth grooves, and the supporting portion is configured to rotate to drive the second connector housing and the first connector housing to move relatively, when the plurality of second teeth are respectively engaged with the plurality of first tooth grooves.

16. The connector housing assembly of claim 15, characterized in that the first rotation lug interferes with the second tooth to prevent the first connector housing from being in plug-in connection with the second connector housing when the plurality of first teeth are improperly engaged with the plurality of second tooth grooves.

17. The connector housing assembly of claim 15, wherein the first connection terminal is in pluggable plug-in connection with the second connection terminal; and when the first connector housing is in plug-in connection with the second connector housing, the first connection terminal is in plug-in connection with the second connection terminal.

* * * * *